United States Patent [19]

Pham Van et al.

[11] 4,338,500

[45] Jul. 6, 1982

[54] DEVICE FOR SWITCHING IN A RESISTANCE WHEN A CIRCUIT BREAKER CLOSES A CIRCUIT

[75] Inventors: Doan Pham Van; Dante Nicoloso, both of Meyzieu, France

[73] Assignee: Societe Anonyme dite: Delle-Alsthom, Villeurbanne, France

[21] Appl. No.: 125,601

[22] Filed: Feb. 28, 1980

[30] Foreign Application Priority Data

Mar. 2, 1979 [FR] France ..... 79 05478

[51] Int. Cl.[3] ..... H01H 33/16; H01H 9/42

[52] U.S. Cl. ..... 200/144 AP; 200/148 A; 200/146 R

[58] Field of Search ..... 200/144 AP, 146 R, 148 A

[56] References Cited

U.S. PATENT DOCUMENTS

| | | | |
|---|---|---|---|
| 3,538,276 | 11/1970 | Leeds | 200/144 AP |
| 3,676,621 | 7/1972 | Pflanz | 200/144 AP |
| 3,863,041 | 1/1975 | Rostron et al. | 200/144 AP |
| 4,009,458 | 2/1977 | Kishi et al. | 200/144 AP |
| 4,072,836 | 2/1978 | Bischofberger et al. | 200/144 AP |

FOREIGN PATENT DOCUMENTS

| | | | |
|---|---|---|---|
| 346301 | 12/1921 | Fed. Rep. of Germany | 200/144 AP |
| 1577693 | 6/1969 | France | 200/144 AP |
| 4318808 | 12/1966 | Japan | 200/144 AP |
| 474832 | 8/1969 | Switzerland | 200/144 AP |
| 430452 | 6/1935 | United Kingdom | 200/144 AP |

*Primary Examiner*—Robert S. Macon

*Attorney, Agent, or Firm*—Sughrue, Mion, Zinn, Macpeak and Seas

[57] ABSTRACT

The invention relates to a resistance switch-in device for switching in only when a circuit breaker closes, said switch-in device including a moving arcing contact in an interrupter chamber. The device is characterized in that the switch-in contacts (2 and 3, 32 and 33) are disposed in the interrupter chamber (1) of the circuit breaker and that since at least one (2,32,33) of said switch-in contacts is a moving contact, it moves on a path parallel to that of the moving arcing contact (5). The invention applies in particular to connecting a load to long-distance high-tension circuits that are unloaded.

11 Claims, 12 Drawing Figures

DEVICE FOR SWITCHING IN A RESISTANCE WHEN A CIRCUIT BREAKER CLOSES A CIRCUIT

FIELD OF THE INVENTION

The invention relates to a circuit-breaker, including a closing resistance switch-in device for limiting overvoltages during simple closing or during rapid reconnection cycle of unloaded long lines.

BACKGROUND OF THE INVENTION

Now, for a fairly large number of devices of this type which easily allow the arc to be quenched without switching in a resistor, it is generally preferable for the closing resistance to be switched in only before the main contacts close and to avoid switching in the resistance during arc interruption.

The above disposition avoids the need to install an arc interrupter unit on the resistance switch-in contacts and makes it possible to reduce the dimensions of the resistance. The dispositions of the prior art consist in connecting an auxiliary closing chamber in parallel with the main chamber of the circuit-breaker, e.g. as described in French patent application No. 77 25 777. However, such dispositions are always bulky and therefore expensive.

The invention aims to provide a less bulky resistance switch-in device which operates when a circuit breaker closes with a more economical cost price.

SUMMARY OF THE INVENTION

The invention provides a resistance switch-in device for switching in a resistance during closing but not during opening of a circuit breaker, said switch-in device including firstly main contacts and arcing contacts in a interrupter chamber; the switch-in devices for said resistance being disposed in the interrupter chamber which is of insulating material, with said resistance being disposed coaxially in said interrupter chamber and to one end of said contacts.

According to another characteristic, one of the contacts which causes the closing resistance to be switched in is fixed to one of the arc interrupter contacts and it is disposed slidably with respect to one of the arcing contacts.

The relative positions of the contact, which, with respect to the arcing contact, slides between the opening position of the circuit breaker and its closing position, are determined by two stops, an opening stop and a closing stop. The opening stop controls the closing of the switch-in contacts before the closing of the arcing contacts and the closing stop controls the opening of the switch-in contacts before the opening of the arcing contacts.

One of the stops can be fixed to the stationary support of the moving arcing contact of the arc interrupter unit while the other stop can be either also fixed to the stationary support of the moving arcing contact or fixed to the stationary support of the stationary contact.

The closing resistance is switched in, either by means of two contact parts which co-operate together, the first being disposed on the moving arcing contact and the support, the second being fixed fast with the support of the stationary arcing contact so as to allow a relative movement of the first part with respect to the stationary contact or by means of two contact parts, one of which is disposed slidably on the stationary arcing contact and is provided with a delay device.

The delay device includes a piston which moves in opposition to a spring in a cylinder equipped with a one-way valve.

With the closing resistance connected between the stationary arcing contact and the contact ensuring that said resistance is switched in during the closing operation, said resistance can be disposed inside an insulating torus which has any given generating surface and whose directing circle center is in the vicinity of the axis of the interrupter chamber.

The characteristics and advantages of the invention become apparent from the description given hereinafter of the embodiments given by way of examples and illustrated in the accompanying drawings.

DESCRIPTION OF PREFERRED EMBODIMENTS

Figure 1:
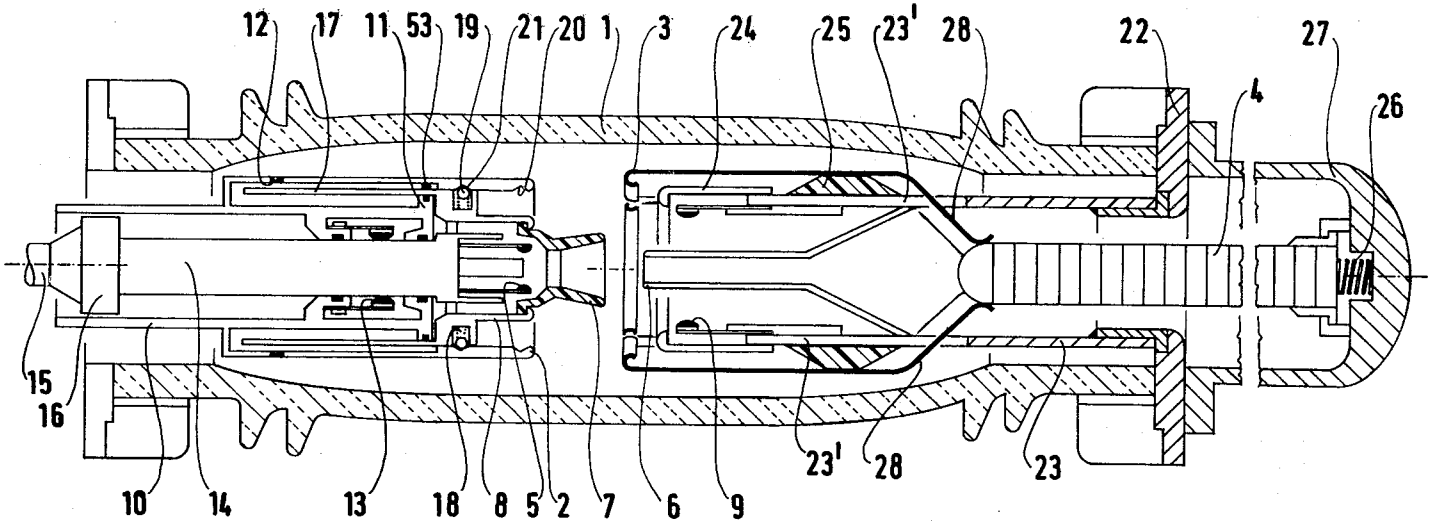
FIG. 1 is an axial cross-section of a circuit-breaker which includes a closing resistance switch-in device in accordance with the invention.

FIG. 1 illustrates a high-voltage circuit-breaker which includes an arc interrupter chamber inside an insulating casing 1, said chamber being filled with a dielectric gas such as sulphur hexafluoride.

The insulating casing 1 of the cut-out chamber contains a tubular main moving contact 8 and a main stationary contact formed by a set of contact fingers 9 disposed at the ends of supports 23, a tubular moving contact 2, a tubular stationary contact 3 which switches in a closing resistance 4 and cut-out arc contacts namely a moving arcing contact 5 and a stationary arcing contact 6; the moving arcing contact 5 is provided with a blast nozzle 7. The main contacts 8 and 9 pass the current when the circuit-breaker is in the closed position. To the left, on the moving part side, the current enters through a stationary tube 10 integral with a stationary piston 11, with a fixed stop 12 for the tubular moving contact 2, and with stationary fingers 13 which pass current between the tube 10 and a moving shaft 14 which is driven by a drive rod 15 and guided by a shoulder 16 free to slide in the tube 10 which thus acts as a support for the moving components. The shaft 14 supports a moving cylinder 17 whose end is provided with recesses 18 each of which contains a ball 19 urged outwardly by a spring. The balls co-operate with two grooves 20 and 21 formed inside the tubular contact 2 which is disposed concentrically around a moving cylinder 17 along which it can slide from one groove to the other. The moving cylinder 17 is provided with a sliding contact 53 which electrically connects the tubular contact 2 thereto. The moving cylinder 17 which surrounds the stationary piston 11 ensures that the gas is compressed. On the stationary contacts side, the current which comes from an end plate 22 passes through the supports 23 whose opposite ends are constituted by arms 23' with two wide openings between them, to the fingers 9 and to a stop 24.

The fingers at the end of the tubular contact 3 are insulated from the support 23 by insulating parts 25. A spring 26 is used to install the resistance 4 resiliently between a metal end 27 of the casing 1, which end is electrically connected to the end plate 22 and connections 28 which pass through the openings between the arms 23' of the support 23, thereby insulating them from these supports.

The device operates as follows.

Figure 2:
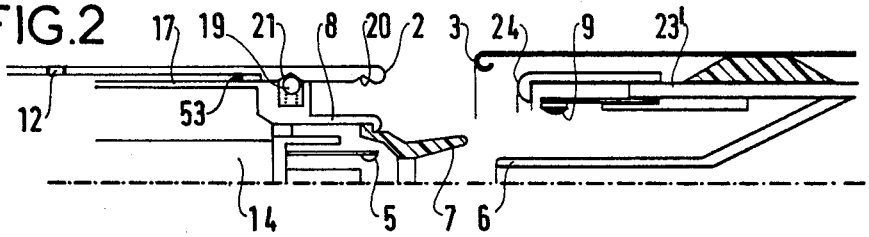
FIG. 2 is an illustration of a portion of the device shown in FIG. 1 in the open position.
Figure 7:
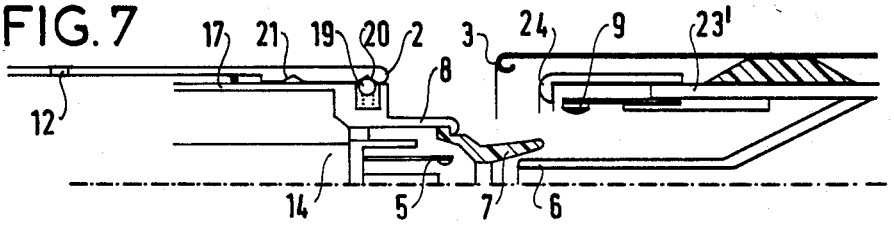
FIG. 7 is an illustration of the device shown in FIG. 2 when the arc is interrupted.

FIGS. 2 and 7 schematically illustrate a sequence of positions which are characteristic of a closing operation followed by an opening operation of the device illustrated in FIG. 1. These figures correspond to fragmentary illustrations of the device in FIG. 1 and even when subsequently referred to not all the components shown in FIG. 1 are always illustrated in these figures. In the fully open position illustrated in FIG. 2, the voltage appears between the moving contacts, namely, the switch-in contact 2, the arcing contact 5 and the main contact 8 on one side and the stationary contacts, namely, the switch-in contact 3 and the arcing contact 6. The stop 24 and the main contact 9 are set further back than the other stationary contacts.

Figure 3:
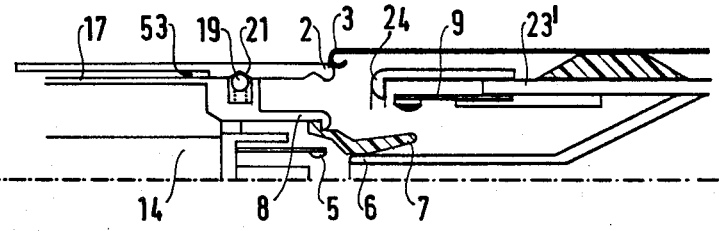
FIG. 3 is an illustration of the device shown in FIG. 2 at the beginning of switching-in the closing resistance.
Figure 4:
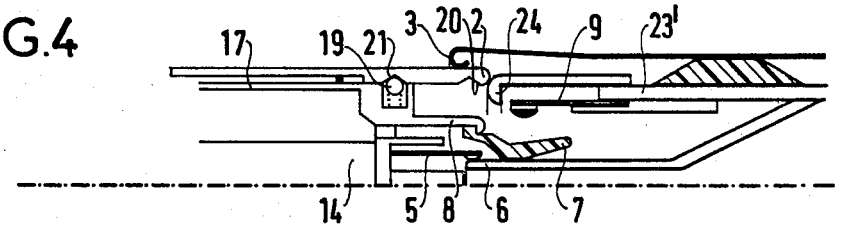
FIG. 4 is an illustration of the device shown in FIG. 2 when the closing resistance is short-circuited.

The movement of the components 5,7,8,14,16, 17 of the moving portion drives the switch-in contact 2 by means of the ball 19 in the groove 21. The tubular contacts 2 and 3 come into contact with each other to switch-in the resistance 4, the circuit being constituted by the conductive components 10, 13,14,17,53,2,3,28,4,27,22, as illustrated in FIG. 3. In FIG. 4, the fact that the moving portion continues to move causes the arcing contacts 5 and 6 to touch each other and to short-circuit the resistance 4, the circuit then being constituted by the conductive components 10,13,14,5,6, 23 and 22. Simultaneously, the switch-in contact 2 touches the stop 24. The continuation of the movement of the moving part leads to the position in FIG. 5. This position corresponds to the closed position; the main contacts 8 and 9 touch each other and short-circuit the arcing contacts. The circuit is constituted by the conductive components 10,13,14,8,9,23 and 22. Simultaneously, the stop 24 prevents the contact 2 from moving with the moving portion and with the balls 19 which form a part thereof and the balls move from the groove 21 to the groove 20.

Figure 5:
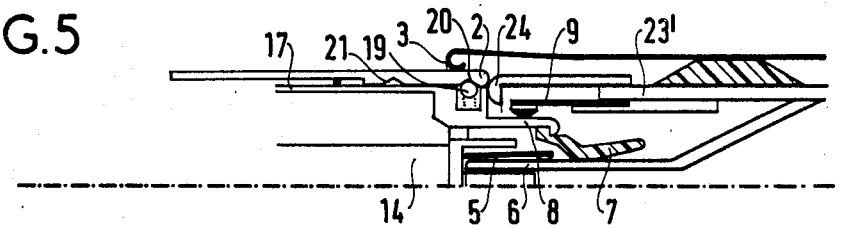
FIG. 5 is an illustration of the device shown in FIG. 2 in the closed position.
Figure 6:
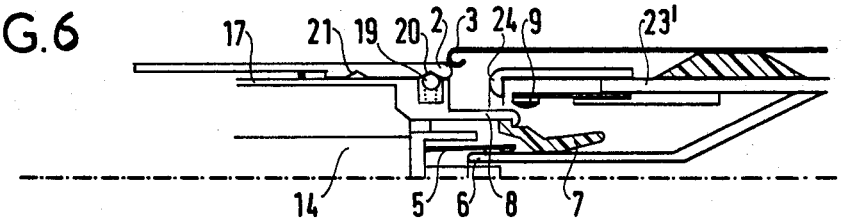
FIG. 6 is an illustration of the device shown in FIG. 2 when the switch-in contacts of the resistance part and before the arcing contacts part.

To effect an opening operation starting from the closed position illustrated in FIG. 5, components 5,7,8,14,15, 16 and 17 of the moving portion move towards the left. When the equipment is in the position shown in FIG. 6, the main contacts 8 and 9 are already separated and the resistance switch-in moving contact 2, driven by the balls 19 which are in the groove 20, is about to part from the stationary switch-in contact 3, but the arcing contacts 5 and 6 are still in contact with each other and short-circuit the circuit of the resistance and thereby prevent it from being switched in when the contact opens. The moving portion continues its movement towards the open position until the moving parts are in the position shown in FIG. 7, where the distance between the tubular switch-in contacts 2 and 3 is greater than the distance between the arcing contacts 5 and 6 and where the moving switch-in contact 2 meets the fixed stop 12. During the subsequent movement, the stop 12 prevents the tubular switch-in contact 2 from moving with the moving part and the balls 19 which form part thereof move out of the groove 20 into the groove 21, this corresponding to the fully open position illustrated in FIG. 2.

Figure 8:
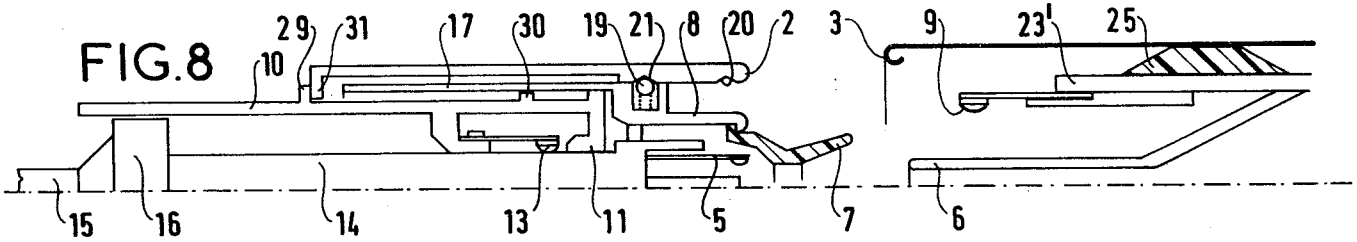
FIG. 8 is an illustration of a portion of the device corresponding to a variant of the invention in the open position.

In FIG. 8, the stops 12 and 24 are replaced respectively by stops 29 and 30 and the end piece 31 of the tubular moving contact 2 abuts against these stops to switch-in the closing resistance, said closing resistance causing the balls 19 to move from the groove 20 to the groove 21 at the end of the contact 2 and vice-versa when the rod 15 and the moving cylinder 17 which is integral therewith move. Like the stops 12 and 24, the stops 29 and 30 are fixed, but they are both located on the moving contact side.

FIG. 8, which corresponds to the opening position of FIG. 2, shows how, during a closing operation, the equipment passes through a position identical to that illustrated in FIG. 3. When the equipment passes from the position which corresponds to FIG. 4 to that which corresponds to FIG. 5, the end piece 31 abuts on the fixed stop 30 instead of the contact 2 abutting on the fixed stop 24. This prevents the contact 2 from moving with the moving portion and moves the balls 19 from the groove 21 to the groove 20 (as in FIG. 5). During the opening operation, the equipment passes through a position identical to that illustrated in FIG. 6. When the equipment passes from the position which corresponds to that illustrated in FIG. 7 to the open position which corresponds to that illustrated in FIG. 2, the end piece 31 abuts against the fixed stop 29 (instead of the contact 2 abutting against the fixed stop 12). This prevents the contact 2 from moving with the moving portion and moves the balls 19 from the groove 20 to the groove 21 (as in FIG. 2).

Figure 9:
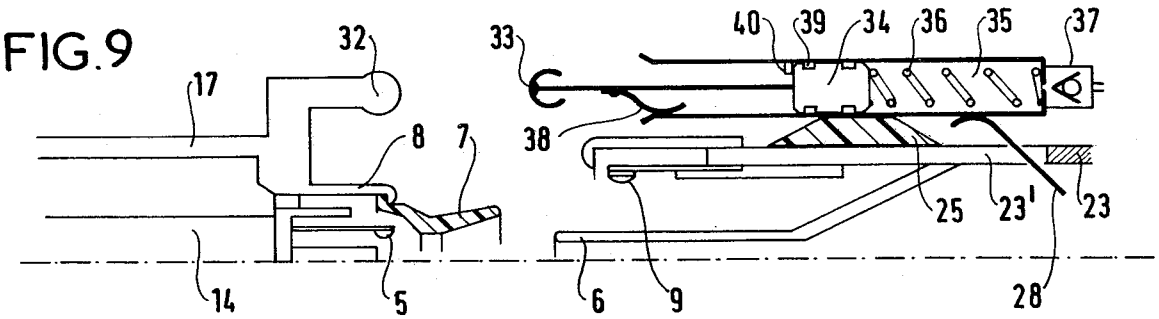
FIG. 9 is an illustration of a portion of another variant of the device in accordance with the invention corresponding to a variant in the open position.
Figure 10:
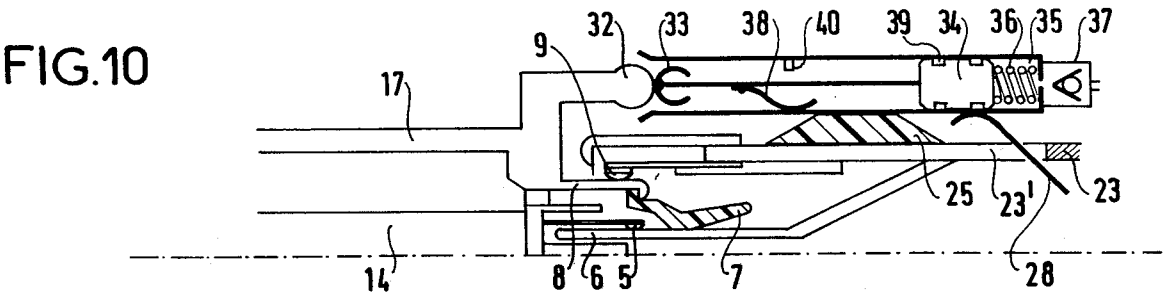
FIG. 10 is an illustration of the device according to FIG. 9 in the closed position.

In FIGS. 9 and 10, the stationary parts (tube 10, piston 11 and the contact fingers 13) which are identical to the same stationary parts in FIGS. 1 and 8 are not illustrated. One of the contacts for switching in a closing resistance 32 is fixed firmly to the moving portion as are the contacts 5 and 8 at the end of the cylinder 17. A second switch-in contact 33 is fixed on a piston 34 which moves in a stationary cylinder 35.

Said cylinder is fast with the stationary components 6 and 9 and with the support 23 and is insulated therefrom by an insulating part 25. When, during the closing operation, the contact 32 pushes the contact 33 away, the piston pushes back a compression spring 36 and the gas compressed in a cylinder 35 escapes through a one-way valve 37. The contact 33 is electrically connected to the cylinder 35 by a sliding contact 38. The guide means of the piston 34 in the cylinder 35 include a calibrated leakage duct schematically illustrated at 39. In combination with the valve 37, said duct determines the valve opening delay.

In the fully open position illustrated in FIG. 9, the stroke of the piston 34 is limited by a stop 40 fixed in the cylinder 35.

The device in FIGS. 9 and 10 operates as follows: during the closing operation, the position of the equipment passes from that illustrated in FIG. 9 to that illustrated in FIG. 10 and successively, part 32 comes into contact with part 33, thus switching the closing resistance 4 into the circuit as in FIG. 3, then the arcing contact 5 comes into contact with the arcing contact 6, thus short-circuiting the resistance (as in FIG. 4), then the permanent contact 8 comes into contact with the permanent contact 9, this corresponding to the closed position (FIG. 10). Meanwhile, the contact 32 pushes the contact 33 and the piston 34 away, pressing back the compression spring 36. The compressed gas in the cylinder 35 escapes through the valve 37. This prevents the movement of the moving portion from being slowed down. During the opening operation which corresponds to passing from the position illustrated in FIG. 10 to that illustrated in FIG. 9 the contact 33 follows the action of the contact 32 with some delay, since the one-way valve 37 is closed by the partial vacuum in the cylinder 35. Due to the calibrated leakage duct 39 in the guide means of the piston 34, the pressure in the cylinder 35 tends to be balanced progressively with respect to the pressure in the chamber; the spring 36 must overcome the difference in pressure between the two surfaces of the piston and slowly moves the contact 33. In these conditions, the contacts 32 and 33 are separated from each other before the arcing contacts 5 and 6. This prevents the resistance from being switched in during the opening operation. The equipment therefore comes to the fully open position illustrated in FIG. 9.

Figure 11:
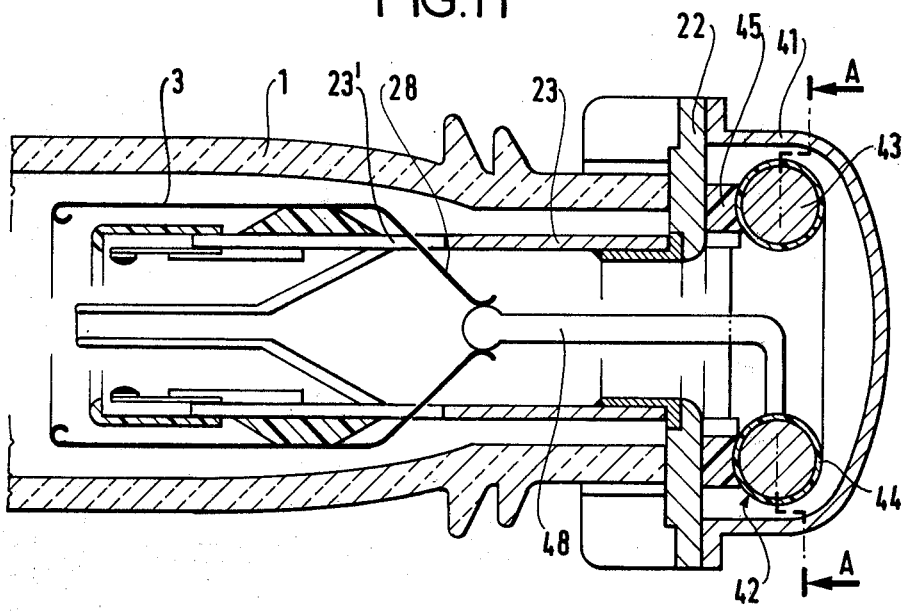
FIG. 11 is an illustration of an axial cross-section of a portion of a circuit-breaker analogous to the one in FIG. 1 and including a variant of a closing resistance.
Figure 12:
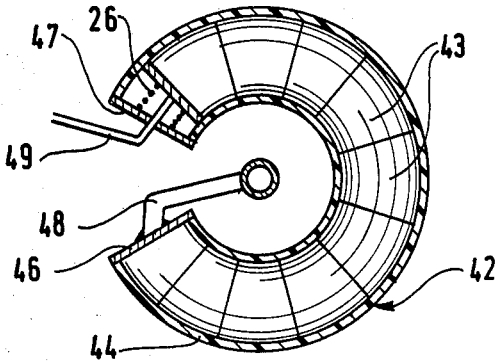
FIG. 12 is a cross-section along line A—A of the closing resistance shown in FIG. 11.

The total length of the cut-out chamber may be reduced while the same insulating casing 1 is used, replacing the longitudinal closing resistance 4 of FIG. 1 by a resistance 42 with an angular shape illustrated in FIGS. 11 and 12. The preceding modification enables the length of the metal end 41 of the casing 1 to be greatly reduced. The resistance 42 formed by a set of components 43 stacked in a toroidal chamber, for example, is contained in an annular insulating casing 44 and is insulated from the metal end 22 by insulating spacers 45. The resistance components 43 are held by clamping plates 46 and 47. The plate 46 is linked to the connections 28 of FIGS. 1 to 11 and 33 of FIGS. 9 and 10 by a connection 48 while the plate 47 is linked to the metal end 41 by the connection 49.

The annular resistance 42 may also be a spiral instead of a circle.

The advantages of the devices in accordance with the invention are the following:

with the devices of FIGS. 1 to 10, the same casing 1 may contain the main contacts and the arcing contacts as well as the switch-in contacts which allow the resistance to be switched in only during the closing operation and not during the opening operation. Further, these devices allow the closing resistor to be housed in the same casing; and these devices allow the use of the usual circuit-breaker mechanisms provided for closing and cutting out without switching in resistances and the switch-in device which is added is well adapted to moving portions with long strokes which are usual at high voltages, where closing resistances are used.

The device does not greatly increase the diameter of the casing. The advantage of the devices of FIGS. 1 to 8 is that they are not very bulky and do not use any springs other than those of the balls.

The advantage of the device of FIG. 8 is that it cancels all shocks on the end of the switch-in contact 2. This avoids having to modify the curve of the corresponding surface. Further, the stops 29 and 30 can be provided with shock-absorber devices since the available space is larger than with the devices of FIGS. 1 to 7.

The device of FIGS. 9 and 10 sometimes damps shocks and sometimes avoids them when coming into contact with the stops. During the closing operation, when the contacts 32 and 33 come into contact with each other, the spring 36 is pushed back and compresses a gas at 35. This corresponds to a resilient shock. During the opening operation, the gas-operated delay device takes the place of the stop to avoid a shock—a disposition which can be used advantageously in short-stroke devices such as high-tension compressed air equipment.

The annular resistances of FIGS. 11 and 12 have the following advantages: the metal end 41 of the casing 1 is shorter. The shape of the end 41 (shorter with a larger diameter) reduces glow discharges. It is more simple to assemble and fix the resistor 42.

It is evident that the invention is in no way limited to the embodiments which have just been described and illustrated and which have been given only by way of examples; in particular, without going beyond the scope of the invention, some dispositions can be modified or some means can be replaced by equivalent means, or even, some components can be replaced by others which could perform the same technical function or and equivalent technical function.

We claim:

1. A highly compact resistance switch-in device for switching in a resistance during closing but not during opening of a circuit breaker, said circuit breaker comprising an elongated cylindrical casing of insulating material defining an interrupter chamber, said switch-in device comprising a set of fixed concentric contacts within said cylindrical casing including firstly a main stationary contact, secondly a switch-in contact, and thirdly an arcing contact, a set of movable contacts including firstly a movable main contact, secondly a movable switch-in contact, and thirdly a movable arcing contact, means for mounting said sets in end-to-end relatively movable position axially disposed within said casing, and said resistance being disposed in said interrupter chamber in axial end-to-end connection to one of said fixed contacts remote from said movable set of contacts.

2. A device according to claim 1, wherein one of the contacts which causes the closing resistance to be switched in is fixed to one of the arcing contacts.

3. A device according to claim 1 or 2, wherein one of the contacts which switches the closing resistance is disposed slidably with respect to one of the arcing contacts.

4. A device according to claim 3, further comprising two stops, said two stops comprising an opening stop and a closing stop, and wherein the relative positions of the contact which, with respect to the arcing contact, slides between the opening position of the circuit breaker and its closing position, are determined by said opening stop and said closing stop, and means for positioning said two stops such that said opening stop controls the closing of the switch-in contacts before the closing of the arcing contacts and the closing stop controls the opening of the switch-in contacts before the opening of the arcing contacts.

5. A device according to claim 3, wherein one of the stops is fixed to the stationary support of the moving arcing contact of the arc interrupter unit and the second stop is fixed to a support of the stationary arcing contact.

6. A device according to claim 3, wherein the two stops are fixed to the stationary support of the moving arcing contact of the arc interrupter unit.

7. A device according to claim 4, wherein the closing resistance is switched in by means of two contact parts which co-operate together, the first part being disposed on the moving arcing contact and the support and the second part being fixed to a support of the stationary arcing contact so as to allow a relative movement of the first part with respect to the stationary contact.

8. A device according to claim 5, wherein the closing resistance is switched in by means of two contact parts, one part being disposed slidably on the stationary arcing contact and being provided with a delay device.

9. A device according to claim 8, wherein the delay device includes a piston which moves in opposition to a spring in a cylinder equipped with a one-way valve.

10. A device according to claim 9, wherein the closing resistance is connected between the stationary arcing contact and the contact ensuring that said resistance is switched in during the closing operation, said resistance is disposed inside said insulating material cylindrical casing which has a given generating surface and whose directing circle center is in the vicinity of the axis of the interrupter chamber.

11. A device according to claim 10, wherein the components of the resistance are stacked in a spiral.

* * * * *